US005146824A

United States Patent [19]

Lajoie

[11] Patent Number: 5,146,824

[45] Date of Patent: Sep. 15, 1992

[54] AUXILIARY PUNCHING DEVICE FOR PUNCHING MACHINE

[76] Inventor: J.-André Lajoie, 730 Côté , St. Charles de Drummond, Canada, J2C 4Z7

[21] Appl. No.: 827,602

[22] Filed: Jan. 29, 1992

[51] Int. Cl.[5] ..... B26D 1/09

[52] U.S. Cl. ..... 83/90; 83/248; 83/468.7; 83/559; 83/620; 83/641; 83/687; 83/934

[58] Field of Search ..... 83/620, 560, 559, 248, 83/90, 934, 640, 641, 468.7, 687

[56] References Cited

U.S. PATENT DOCUMENTS 2,319,568 5/1943 Wales ..... 83/559 X 3,198,051 8/1965 Ablon ..... 83/620 X 3,368,441 2/1968 Piazze ..... 83/620 X

*Primary Examiner*—Frank T. Yost

*Assistant Examiner*—Kenneth Peterson

[57] ABSTRACT

An auxiliary punching device is disclosed, which is attachable to a machine for punching holes at one given location into a stack of sheets of given size, in order to punch other holes at another given location in the same stack at the very same time as the holes are punched at the one location. This auxiliary punching device comprises an auxiliary die and an auxiliary punching tool that are attachable to the main die and punching tool of the punching machine to work in unison therewith. Both of the structural elements are very easy to adjust to fit any required positioning or configuration for the second row of holes to be punched, whatever be the size of the stack of sheets fed to the machine.

9 Claims, 4 Drawing Sheets

AUXILIARY PUNCHING DEVICE FOR PUNCHING MACHINE

BACKGROUND OF THE INVENTION

1) Field of the Invention

The present invention relates to an auxiliary punching device attachable to a machine for punching holes at one given location into a stack of sheets of given size, which device permits to punch other holes at another given location in the same stack at the very same time as the holes are punched at the one location.

b) Brief Description of the Prior Art

Machines for punching holes into a stack of paper are well known and commonly used in the printing industry for different purposes such as, for example, punching a row of equally spaced apart holes along one of the vertical edges of the pages of a diary or of a calendar to make these pages connectable to each other by mere insertion into the holes of a coil-shaped metal binding.

For some particular applications such as the manufacture of diaries with detachable corners or tabs, or of booklets of coupons, it is often necessary to punch at least one other row of holes into the same pages, this other row often extending in a different direction and being made of holes of different size.

In practice, this has been done so far in three different ways.

The first one which is the most widely used, consists in passing the stack of pages to be punched through the punching machine to punch the first row of holes, then replacing the original die and punching tool assembly of this machine by another different one and finally passing again the same stack of pages into the machine to punch the other row of holes using the other die and punching tool assembly to do so.

As can be understood, this first method is time consuming as it requires to pass each stack twice into the same machine, with the risk of errors that may result from such a manipulation.

A second way of punching two rows of holes into a stack of sheets consists in manufacturing a custom-made die and punching tool assembly capable of punching these two rows and mounting this custom-made assembly onto the punching machine in lieu of the original assembly. This second method is efficient but very expensive.

A third way of punching two rows of boles into a stack of sheets that has apparently been tried by some printers, consists in attaching an auxiliary die and punching tool assembly to the die and punching tool assembly in such a manner that both assemblies work in unisson. This third method is efficient and not very expensive. However, to the Applicant's knowledge, noone has devised so far an auxiliary punching device of this type that is really adjustable to fit any required positioning and configuration for the second row of holes, or any size of sheets of paper to be punched.

OBJECT OF THE INVENTION

The object of the invention is to provide an auxiliary punching device of the above mentioned type, that is attachable to the main die and punching tool assembly of an existing punching machine to work in unison therewith, that is very simple in structure and operation and that, above all, is very easy to adjust to fit and required positioning or configuration for the second row of holes to be punched, whatever be the size of the stack of sheets fed to the machine.

SUMMARY OF THE INVENTION

More particularly, the present invention provides an auxiliary punching device attachable to a machine for punching holes at one given location into a stack of sheets of a given size, this machine being of the type comprising:

(a) a frame having a longitudinal axis;

(b) a main punching assembly transversally onto the frame, the main punching assembly comprising:

a main die rigidly mounted onto the frame;

a main punching tool including a ram supporting a set of punches facing the main die, the ram being reciprocable in a direction perpendicular to the longitudinal axis between a feed position where the punches extend away from the main die and define therewith a gap, and a punching position where the punches engage this main die; and a ram actuator for reciprocating the ram between the feed and punching positions;

(c) a feed carriage for longitudinally feeding the stack to be punched into the gap when the ram is in the feed position;

(d) retractable stopping means for stopping the stack in a preselected longitudinal position with respect to the main die when the stack is fed into the gap;

(e) at least one actuable back guide adjustable according to the size of the sheets, for pressing the stack against the stopping means after said stack has been fed, and thus ensuring that said stack is longitudinally well positioned relative to said main die;

(f) side guides located on both sides of the feed carriage for transversely positioning said stack with respect to said main die, at least one of said side guides being adjustable so as to fit the size of the sheets;

(g) a delivery conveyor for removing the punched stack from the gap after the ram has been reciprocated and is back in the feed position before feeding a new stack to be punched; and (h) control means for sequentially operating said feed carriage, stopping means, at least one back guide, ram actuator and delivery conveyor.

The auxiliary punching device according to the invention is intended to be used in unison with the main punching other holes at another given location into the same stack and is characterized in that it comprises:

(i) a first arm rigidly connecting a first mounting plate to a first supporting plate;

(j) means for rigidly attaching the first mounting plate to the frame so that the first supporting plate extends toward the stack fed to the main punching assembly;

(k) an auxiliary die carrier slidably mounted on the first supporting plate, the auxiliary die carrier being slidable in one given direction with respect to the first supporting plate and lockable in one selected position along this one direction;

(l) an auxiliary die slidably mounted onto the auxiliary die carrier, the auxiliary die being slidable in another given direction perpendicular to the one direction with respect to the auxiliary die carrier and lockable in another selected position along the other direction, the auxiliary die extending substantially in the same plane as the main die;

(m) a second arm rigidly connectiong a second mounting plate to a second supporting plate, the second mounting and supporting plates being perpendicular to theach other;

(n) means for rigidly attaching the second mounting plate to the ram so that the second supportring plate faces the first supporting plate;

(o) an auxiliary punching tool carrier slidably mounted onto the second supporting plate, the auxiliary punching tool carrier being slidable in the one given direction with respect to the second supporting plate and lockable in this one selected position along the one direction; and (p) an auxiliary punching tool slidably mounted onto the auxiliary punching tool carrier, the auxiliary punching tool including another set of punches and being slidable in the other direction perpendicular to the one direction and lockable in the other selected position along this other direction so as to face and operatively cooperate with the auxiliary die, the auxiliary punching tool extending substantially in the same plane as the main punching tool;

whereby, in use, the auxiliary punching tool is reciprocated in unison with the main punching tool and punches the other holes at the other location into the stack at the very same time as holes are punched at the one location by the main punching tool.

Preferably, the one and other direction perpendicular to each other are respectively parallel to the invention has the following advantages:

it is very simple in structure and operation;

it is easy to adjust to fit any customer requirement;

it reduces by at least one half the amount of time necessary to punch two different rows of hole into a same stack as compared to the most widely used method;

it reduces to the same extent the handling that is required to feed each batch of stacks to the machine, thereby reducing the risk of errors.

The invention will be better understood upon reading of the following non restrictive description of a preferred embodiment thereof, made with reference to the accompanying drawings.

DESCTIPTION OF A PREFERRED EMBODIMENT OF THE INVENTION

Figure 2:
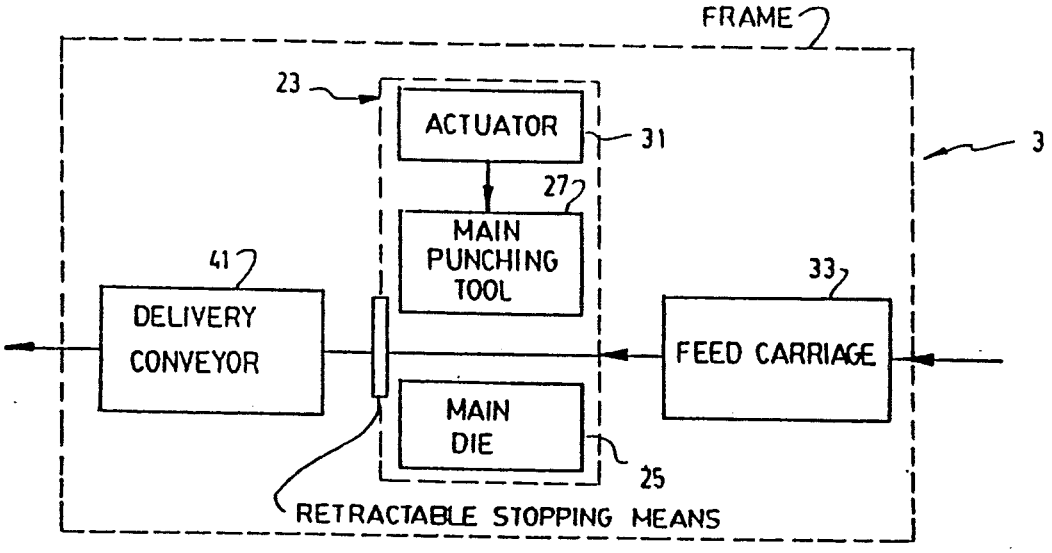
FIG. 2 is a schematic representation of the main components of a conventinal machine for punching holes into a stack of paper.
Figure 3:
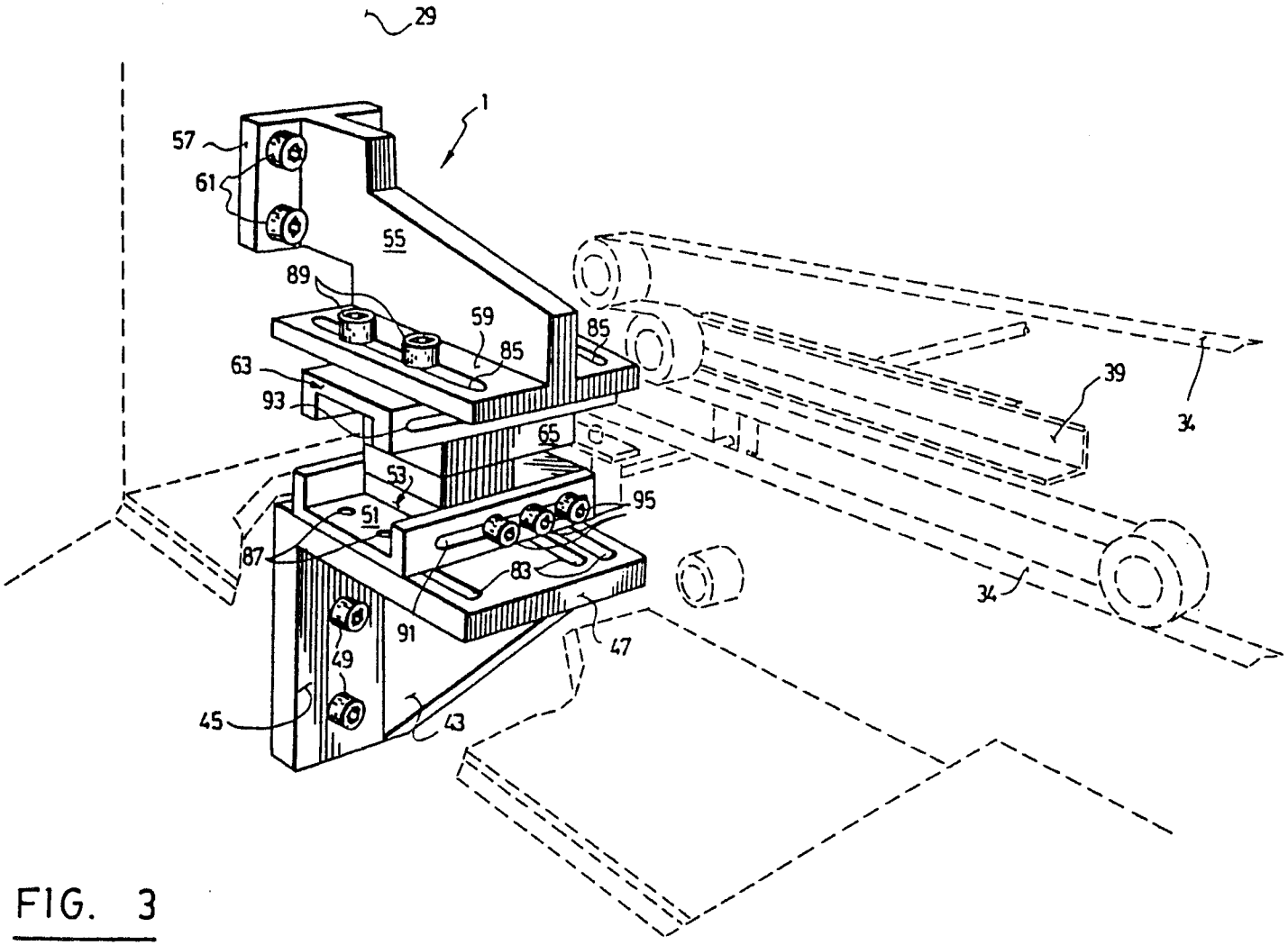
FIG. 3 is a perspective view of an auxiliary punching device according to the invention, attached to the main punching tool and die of a machine as represented in FIG. 2.
Figure 4:
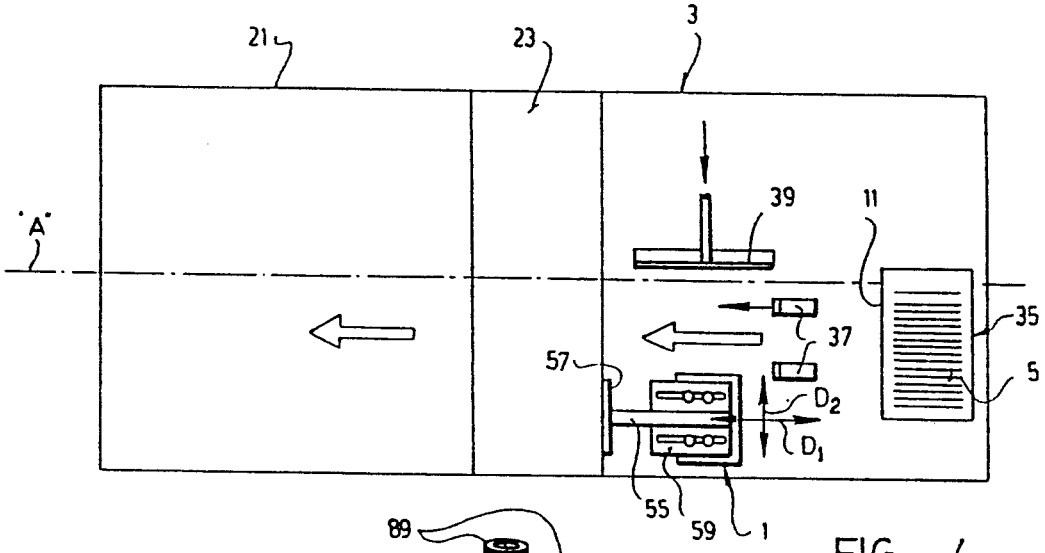
FIG. 4 is a top plan view of the machine shown in part in FIG. 3.
Figure 5:
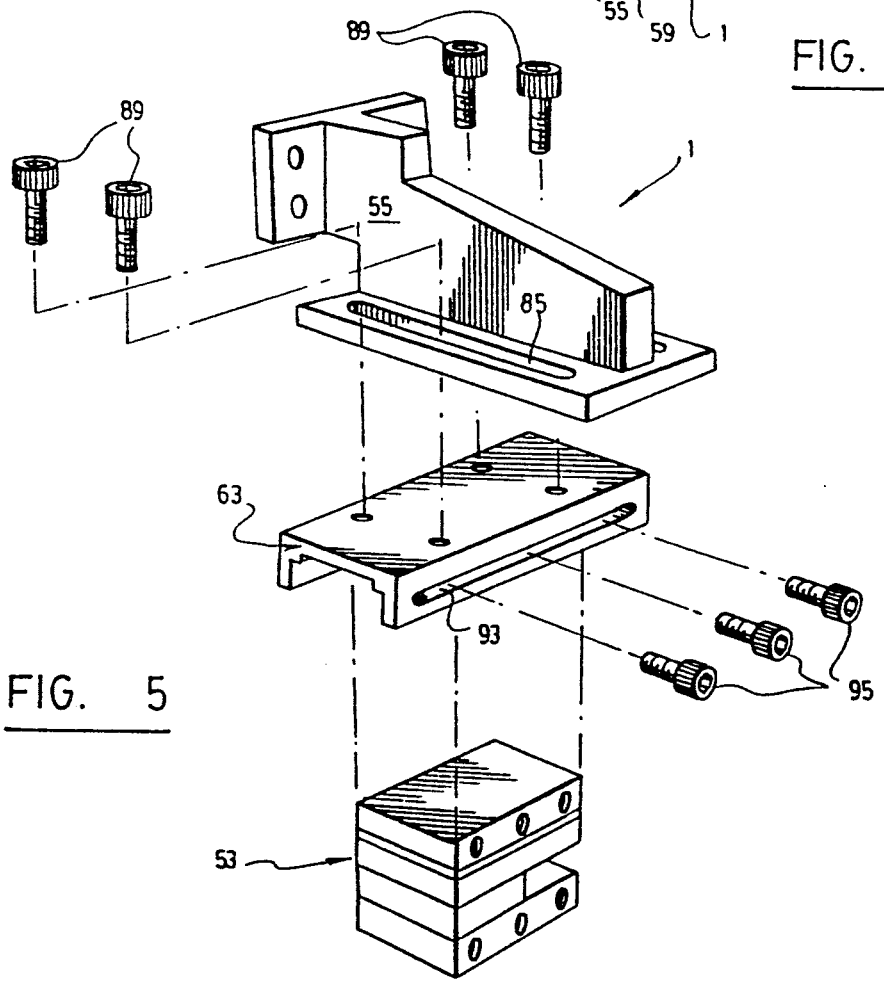
FIG. 5 is an exploded perspective view of the auxiliary punching tool and die and the auxiliary punching tool carrier of the auxiliary punching device shown in FIG. 3.

The auxiliary punching tool device 1 according to the invention as shown in the accompanying drawings (see FIGS. 3 and 4) is intended to be attached to, and used with a conventional punching machine 3 as shown in FIGS. 2 and 4, which is commonly used in the trade for punching holes at one given location into a stack of sheets of paper of a given size.

As already explained hereinabove, the manufacture of diaries with detachable corners or tabs, booklets of coupons and other similar products, often require to punch two or more rows of holes into the same pages, the rows often extending in different directions and being made of holes of different size.

Figure 1:
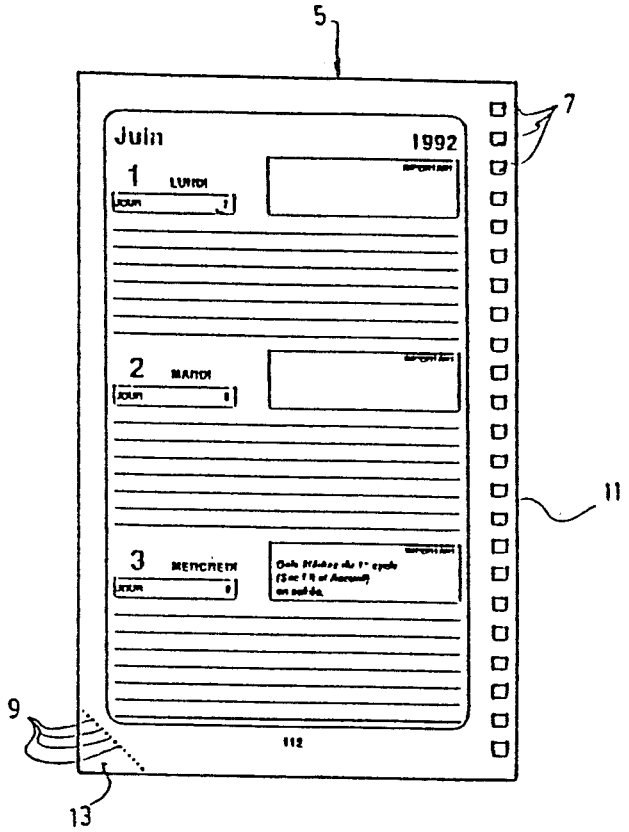
FIG. 1 is a representation of a page of a diary with two rows of holes of different sizes punched at different locations, as can be obtained in accordance with the invention.

FIG. 1 illustrates a page 5 of diary of the above mentioned type, comprising two different rows of holes 7, 9, one of which, say the row of holes 7, extending along one of the vertical edges 11 of the page 5 to make it connectable to a plurality of other similar pages by means of a coil-shaped metal binding. The other row of holes 9 that are much smaller in size than the holes 7, extend at 45° across the bottom corner 13 of the page 5, that is opposite the edge 11. This other row of holes 9 makes the corner 13 easy to tear off to mark page 5 whenever desired.

As already indicated hereinabove, the auxiliary punching device 1 according to the invention makes it possible to punch both rows of holes 7 and 9 in a stack of pages at the very same time, in one single passage through the punching machine 3.

As also indicated hereinabove, the punching machine 3 to which the auxiliary device according to the invention is connected, is a machine well known in the art. An example of such a machine presently available in the trade and widely used in North America is the one sold under the tradename STERLING PUNCHMASTER—15 by NORTON SPIEL ASSOCIATES, INC. of Long Island City (New York).

Referring to FIGS. 2 and 4, the punching machine 3 can be broadly described as comprising a frame 21 having a longitudinal axis A, on which a main punching assembly 23 is mounted. The assembly 23 comprises a main die 25 rigidly mounted onto the frame and a main punching tool 27 including a ram 29 (see FIG. 3) supporting a set of punches facing the main die. The ram is reciprocable in a direction perpendicular to the longitudinal axis A, between a feed position where the punches extend away from the main die and define therewith a gap, and a punching position where the punches engage the main die (see FIG. 2).

Reciprocation of the ram between the feed and punching position is achieved by means of ram actuator 31 mounted onto the frame above the main punching tool.

A feed carriage 33 usually comprising a pair of belt conveyors 34 (see FIG. 3) is provided for longitudinally feeding a stack 35 of pages 5 to be punched into the gap, when the ram is in the feed position. Such a feeding is carried out so that the vertical edges 11 where the "main" row of holes 7 is to be punched, extend transversally and enter first into the punching zone.

Retractable stopping means are provided for stopping the stack in a preselected longitudinal position with respect to the main die when the stack is fed into the gap.

At least one and preferably two actuable back guides 37 are used for pressing the stack 35 against the stopping means after this stack has been fed. The purpose of these back guides that are adjustable according to the size of the pages 5 to be punched is essentially to ensure that the stack is well positioned longitudinally relative to the main die.

Side guides located on both sides of the feed carriage are also used for transversely positioning the stack with respect to the main die. At least one of these side guides, numbered 39 in FIGS. 3 and 4, is transversally adjustable so as to fit the size of the pages 5.

Downstream of the punching assembly 23, a delivery conveyor 41 is mounted for removing the punched stack from the gap after the ram has been reciprocated and is back in the feed position, before feeding a new stack to be punched.

Of course, control means (not shown) are provided for sequentially operating the feed carriage 33, the stopping means, the adjustable back guide 39, the ram actuator 31 and the delivery conveyor 41.

As aforesaid, the punching machine 3 is known per se. Accordingly, it is felt that its basic structure and the way it operates need not be further described.

The auxiliary punching device 1 according to the invention is intended to be used in unison with the main punching assembly 23 of the machine for simultaneously punching another row of holes 9 at another given location into the pages 5 of the same stack 35. As shown in FIG. 3, the auxiliary punching device 1 comprises a first arm 43 rigidly connecting a first mounting plate 45 to a first supporting plate 47. Means such as bolts 49 are used for rigidly attaching the first mounting plate 45 to the frame 21 so that the first supporting plate 47 extends toward the stack fed to the main punching assembly, as is shown in FIG. 4.

An auxiliary die carrier 51 is slidably mounted on the first supporting plate 47. This auxiliary die carrier 51 whose structure will be described in greater details hereinafter is slidable in one given direction $D_1$ (see FIG. 4) with respect to the first supporting plate 47 and lockable in one selected position along the one direction $D_1$. As shown in FIG. 4, the one direction $D_1$ is preferably parallel to the longitudinal axis A of the frame.

An auxiliary die 53 is slidably mounted onto the auxiliary die carrier 51 in such a manner as to extend substantially in the same plane as the main die 25. This auxiliary die 53 is slidable with respect to the auxiliary die carrier in another given direction $D_2$ (see FIG. 4) perpendicular to the one direction $D_1$. The auxiliary die 53 is also lockable in another selected position along the other direction $D_2$ which is, of course, also perpendicular to the longitudinal axis A of the frame.

The auxiliary punching device 1 further comprises a second arm 55 rigidly connecting a second mounting plate 57 to a second supporting plate 59. As shown in FIGS. 3 and 4, the second mounting plate 57 and supporting plates 59 are perpendicular to each other. Means such as bolts 61, are used for rigidly attaching the second mounting plate 57 to the ram 29 so that the second supporting plate 59 faces the first supporting plate 47.

An auxiliary punching tool carrier 63 is slidably mounted onto the second supporting plate 59. This auxiliary punching tool carrier 63 is also slidable in the one given direction $D_1$ with respect to the second supporting plate and is lockable in the very same one selected position along the one direction $D_1$.

The auxiliary punching tool carrier 63 supports an auxiliary punching tool 65 that is slidably mounted on it so as to extend substantially in the same plane as the main punching tool 27. The auxiliary punching tool 65 includes another set of punches 67 (see FIG. 6) . It is slidable in the other direction $D_2$ perpendicular to the one direction $D_1$ and longitudinal axis A, and is lockable in the other selected position along this other direction $D_2$ so as to face and operatively cooperate with the auxiliary die 53.

Such a specific positioning of the auxiliary die and punching tool 53 and 65 in aligned vertical relationship, allows the same to cooperate to punch the required other row of holes 9. Such a specific positioning also allows, in use, the auxiliary punching tool 65 to be reciprocated in unison with the main punching tool 27 to punch the other holes 9 at the other location into the stack at the very same time as the holes 7 are punched at the one location by the main punching tool 27.

Figure 6:
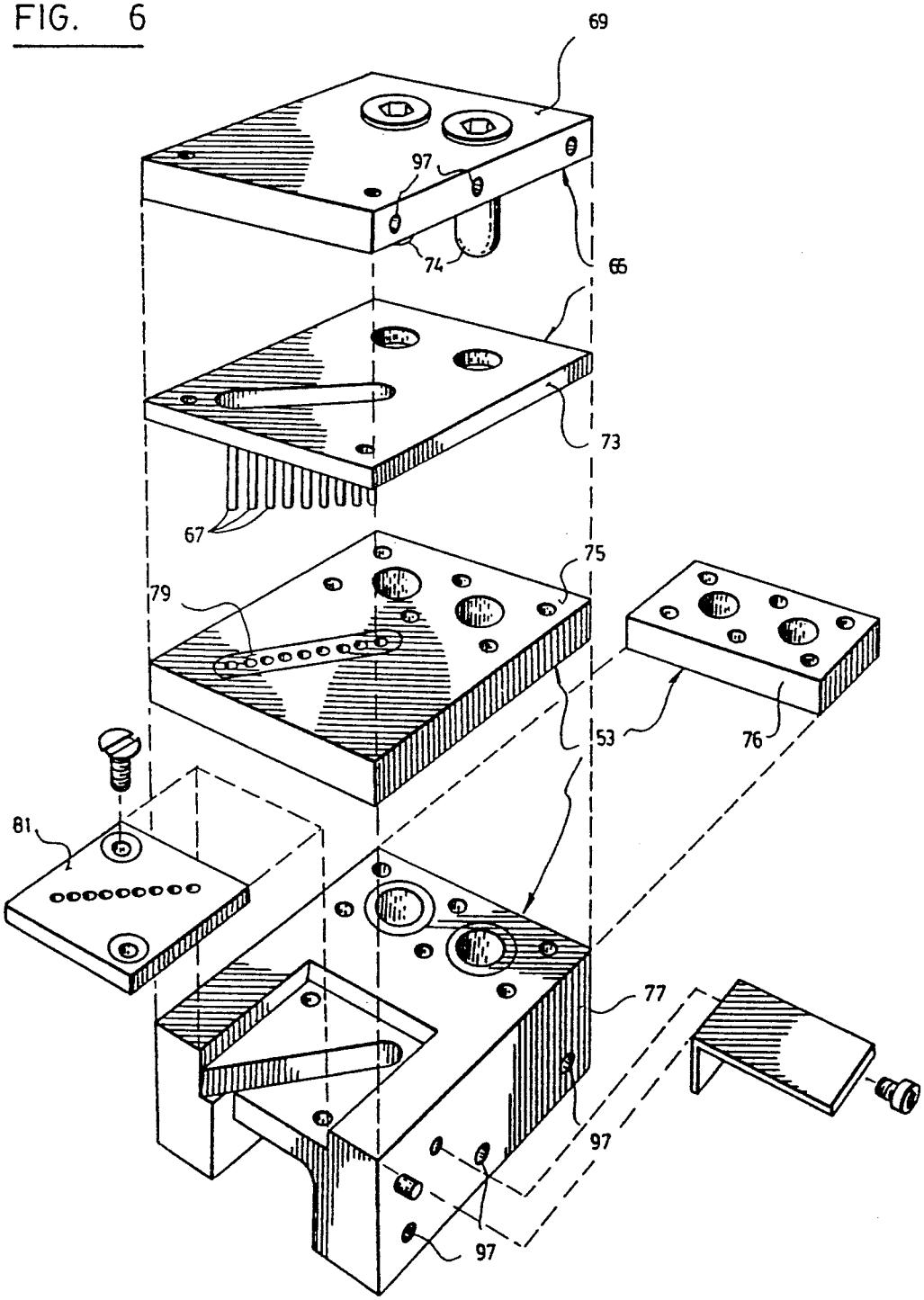
FIG. 6 is an exploded perspective view of the auxiliary punching tool and die shown in assembled form in FIGS. 3 and 5.

As shown in FIG. 6, the auxiliary punching tool has an upper plate 69 from which at least two guide pins 71 project towards the auxiliary die 53. These guide pins 71 slidably engage corresponding guide holes provided in the lower plate 73 of the auxliary punching tool 65 and in various interchangeable plates 75, 76 and 77 forming the auxiliary die 53. Advantageously, the guide pins 71 are positioned to act as one of the two side guides of the machine 3, i.e. the one which is opposite the adjustable side guide 39.

As also shown in FIG. 6, the other set of punches 67 of said auxiliary punching tool 65 and the corresponding receiving or guiding portions 79, 81 of the auxiliary die 53 are detachably mounted onto the lower plate 73 of the punching tool and the plates 75 and 77 of the auxiliary die, respectively, in order to make this other set of punches interchangeable with other sets of punches of different size, spacing and/or alignment. In other words, depending on the kind of auxiliary punching that may be required, the elements 67, 79 or 81 may be changed, or other plates 73, 75, 81 and 77 incorporating similar elements of different sizes or positions may be used, therey increasing to an unlimited extent the versatility of the auxiliary punching device according to the invention.

Referring back to FIG. 3, each of the first and second supporting plates 47, 59 has at least one and preferably two or three elongated slots 83, 85 extending in the one direction $D_1$. Each of the auxiliary die and punching tool carriers 51, 63 is U-shaped in cross-section and comprises a flat bottom wall having one flat bottom side from which a pair of opposite side walls project and another side from which two or more bolts 87, 89 project. The bolts 87, 89 are sized to fit into the slots 83, 85 of the corresponding supporting plates 47, 59. These bolts extend in a plane perpendicular to the bottom wall and the side walls of the carriers 51, 63 so that, when they are inserted into their respective slots, the side walls of the carriers extend in the other direction $D_2$ perpendicular to the one direction $D_1$.

Nuts (not shown) can be threaded onto the bolts 87, 89 to lock each of the auxiliary die and punching tool to their corresponding supporting plates after having inserted the bolts into the corresponding slots and having slid the auxiliary die or punching tool to the one selected position.

Of course, the auxiliary punching tool and die 65, 53 are sized to fit into the U-shaped auxiliary punching tool and die carriers 51, 63 respectively, and to slide within the same between their respective side walls.

As also shown in FIG. 3, each of side walls of the auxiliary and the die punching tool carriers 61, 63 are provided with an elongated slot 91, 93, respectively.

Screws like those numbered 95, sized to fit into the elongated slots 91, 93 the side walls, are threaded into corresponding holes 97 made in lateral walls of the lower plate 77 of the die of the auxiliary die and in the upper plate 69 of the punching tool to lock these auxiliary die and punching tool to the auxiliary die punching tool carriers, respectively.

As can be understood, the auxiliary punching device 1 according to the invention is easily attachable to the main die and punching tool assembly of an existing punching machine to work in unison therewith. It is very simple in structure and operation and above all, it is very easy to adjust along $D_1$ and/or $D_2$ to fit any required positioning or configuration for the second row of holes 9 to be punched in the pages 5, whatever be the size of the stack 35 fed to the machine 3.

I claim:

1. An auxiliary punching device attachable to a machine for punching holes at one given location into a stack of sheets of given size, said auxiliary device being useful for simultaneously punching other holes at another given location into the same stack, said machine to which said auxiliary device is attachable being of the type comprising:

(a) a frame having a longitudinal axis;

(b) a main punching assembly transversally mounted onto said frame, said main punching assembly comprising:

a main die rigidly mounted onto the frame;

a main punching tool including a ram supporting a set of punches facing the main die, said ram being reciprocable in a direction perpendicular to said longitudinal axis between a fed position where the punches extend away from the main die and define therewith a gap, and a punching position where the punches engage said main die; and a ram actuator for reciprocating said ram between said feed and punching positions;

(c) a feed carriage for longitudinally feeding said stack to be punched into said gap when the ram is in the feed position;

(d) retractable stopping means for stopping the stack in a preselected longitudinal position with respect to the main die when said stack is fed into the gap;

(e) at least one actuable back guide adjustable according to the size of the sheets, for pressing the stack against the stopping means after said stack has been fed, and thus ensuring that said stack is longitudinally well positioned relative to said main die;

(f) side guides located on both sides of the feed carriage for transversely positioning said stack with respect to said main die, at least one of said side guides being adjustable so as to fit the size of the sheets;

(g) a delivery conveyor for removing the punched stack from the gap after the ram has been reciprocated and is back in the feed position before feeding a new stack to be punched; and (h) control means for sequentially operating said feed carriage, stopping means, at least one back guide, ram actuator and delivery conveyor;

wherein said auxiliary device comprises:

(i) a first arm rigidly connecting a first mounting plate to a first supporting plate;

(j) means for rigidly attaching the first mounting plate to said frame so that the first supporting plate extends toward the stack fed to the main punching assembly;

(k) an auxiliary die carrier slidably mounted on said first supporting plate, said auxiliary die carrier being slidable in one given direction with respect to said first supporting plate and lockable in one selected position along said one direction;

(l) an auxiliary die slidably mounted onto said auxiliary die carrier, said auxiliary die being slidable in another given direction perpendicular to the one direction with respect to said auxiliary die carrier and lockable in another selected position along said other direction, said auxiliary die extending substantially in the same plane as said main die;

(m) a second arm rigidly connecting a second mounting plate to a second supporting plate, said second mounting and supporting plates being perpendicular to each other;

(n) means for rigidly attaching the second mounting plate to the ram so that the second supporting plate faces the first supporting plate;

(o) an auxiliary punching tool carrier slidably mounted onto said second supporting plate, said auxiliary punching tool carrier being slidable in said one given direction with respect to said second supporting plate and lockable in said one selected position along said one direction; and (p) an auxiliary punching tool slidably mounted onto said auxiliary punching tool carrier, said auxiliary punching tool including another set of punches and being slidable in said other direction perpendicular to the one direction and lockable in said other selected position along said other direction so as to face and operatively cooperate with said auxiliary die, said auxiliary punching tool extending substantially in the same plane as said main punching tool;

whereby, in use, said auxiliary punching tool is reciprocated in unison with said main punching tool and punches said other holes at said other location into the stack at the very same time as said holes are punched at the on location by said main punching tool.

2. The auxiliary punching device of claim 1, wherein one of said one and other directions perpendicular to each other is parallel to the longitudinal axis of the frame.

3. The auxiliary punching device of claim 2, wherein one of said auxiliary punching tool and die comprises at least two guide pins projecting towards the other one of said auxiliary punching tool and die, said guide pins slidably engaging corresponding guide holes provided in said other one of said auxiliary punching tool and die.

4. The auxiliary punching device of claim 3, wherein said at least two guide pins are positioned to act as one of said side guides of the machine.

5. The auxiliary punching device of claim 3, wherein said other set of punches of said auxiliary punching tool and the corresponding portion of said auxiliary die are detachably mounted onto said auxiliary punching tool and said auxiliary die respectively, thereby making said other set of punches interchangeable with at least one further set of punches of different size, spacing and/or alignment.

6. The auxiliary punching device of claim 3, wherein:

each of said first and second supporting plates has at least one elongated slot extending in said one given direction;

each of said auxiliary die and punching tool carriers is U-shaped in cross-section and comprises a flat bottom wall having one side from which a pair of opposite side walls projecting and another side from which at least two bolts project, said bolts being sized to fit into said at least one slot of the corresponding supporting plate and extending in a plane perpendicular to said bottom wall and to said side walls so that, when said at least two bolts are inserted into said at least one slot, said side walls extending in said other direction perpendicular to said one direction, nuts threadable onto said at least two bolts are provided to lock each of said auxiliary die and punching tool to the corresponding supporting plate after having inserted said at least two bolts into said at least one slot and having slid said auxiliary die or punching tool to said one selected position, and said auxiliary punching tool and die are sized to fit into said U-shaped uaxiliary punching tool and die carreirs, respectively, and to slide within the same between their respective side walls.

7. The auxiliary punching device of claim 6, wherein:

each of said side walls of said auxiliary punching tool and die carriers are provided with an elongated slot; and screws sized to fit into the elongated slots of said side walls and threadable into corresponding holes made in lateral walls of said auxiliary punching tool and die are provided to lock said auxiliary punching tool and die to said auxiliary punching tool and die carrier, respectively.

8. The auxiliary punching device of claim 7, wherein said at least two guide pins are positioned to act as some of said side guides of the machine.

9. The auxiliary punching device of claim 8, wherein said other set of punches of said auxiliary punching tool and the corresponding portion of said auxiliary die are detachably mounted onto the said auxiliary punching tool and said auxiliary die respectively, thereby making said other set of punches interchangeable with at least one further set of punches of different size, spacing and/or alignment.

* * * * *